US006114999A

United States Patent [19]

Cassel et al.

[11] Patent Number: 6,114,999

[45] **Date of Patent: *Sep. 5, 2000**

[54] FIELD CONTROLLED RESONATOR

[75] Inventors: Erland Cassel; Jan Cassel, both of Djursholm, Sweden

[73] Assignee: Telefonaktiebolaget LM Ericsson, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/961,028

[22] Filed: Oct. 30, 1997

[30] Foreign Application Priority Data

Nov. 8, 1996 [SE] Sweden ..... 9604096

[51] Int. Cl.[7] ..... H01Q 1/24

[52] U.S. Cl. ..... 343/702; 343/834; 343/895

[58] Field of Search ..... 343/834, 702, 343/720, 727, 833, 841, 885, 893, 895

[56] References Cited

U.S. PATENT DOCUMENTS

| | | | |
|---|---|---|---|
| 3,235,805 | 2/1966 | Hings | 343/895 |
| 4,868,576 | 9/1989 | Johnson, Jr. | 343/702 |
| 5,335,336 | 8/1994 | Kametani . | |
| 5,338,896 | 8/1994 | Danforth . | |
| 5,367,309 | 11/1994 | Tashjian . | |
| 5,373,304 | 12/1994 | Nolan et al. . | |
| 5,572,224 | 11/1996 | Moller et al. | 343/702 |
| 5,668,557 | 9/1997 | Kawahata | 343/700 MS |
| 5,694,137 | 12/1997 | Wood | 343/702 |
| 5,710,569 | 1/1998 | Oh et al. | 343/817 |

FOREIGN PATENT DOCUMENTS

| | | |
|---|---|---|
| 1 552 233 | 9/1979 | United Kingdom . |
| 2 301 228 | 11/1996 | United Kingdom . |
| WO94/14208 | 6/1994 | WIPO . |
| WO94/28595 | 12/1994 | WIPO . |
| WO95/31048 | 11/1995 | WIPO . |

*Primary Examiner*—Don Wong
*Assistant Examiner*—James Clinger
*Attorney, Agent, or Firm*—Burns, Doane, Swecker & Mathis, L.L.P.

[57] ABSTRACT

An antenna device for a Mobile Phone is disclosed, wherein a distance between a miniaturized radiator and a miniaturized reflector may be shortened by means of an introduced dielectric material optimizing the electrical distance between the radiator and reflector to create a compact antenna unit having a desired cardioid shaped radiation pattern. Furthermore an additional field reducing means in the form of metallic strips is used, for example utilizing an additional dielectric layer, with at least two thin isolated metallic strips running parallel to the current edges of the reflector element to thereby form chokes at the back of the reflector, which is normally directed towards the user, to further concentrate the near-field on this side to an area in between the chokes.

28 Claims, 2 Drawing Sheets

Fig.1
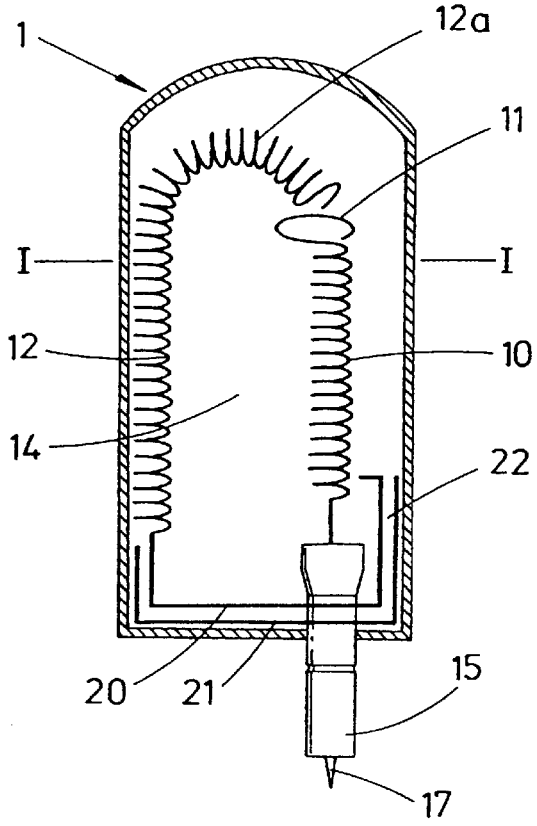
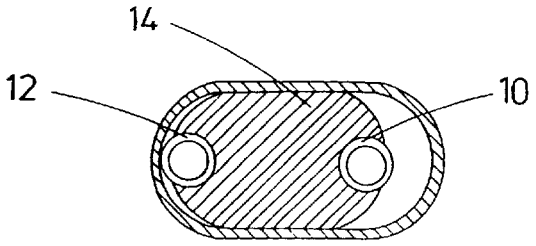
Fig.2

FIELD CONTROLLED RESONATOR

FIELD OF THE INVENTION

The present invention relates to an antenna device for radio transmitting devices and more particularly the present invention pertains to a miniaturized antenna designed to improve antenna efficiency by directing the radiated electromagnetic field generated away from the user when using a radio telephone.

BACKGROUND

A typical handhold radio telephone typically operates in a frequency range of about 900 MHz in a GSM 900 cellular system. However, a radio telephone may also operate in a satellite radio communication system as well as in other cellular systems like GSM 1800, D-AMPS 800, D-AMPS 1900, DCS 1800, PCS 1900, PDC 800 and PDC 1500. Besides receiving electromagnetic energy in a particular frequency range, the device, via its antenna, also radiates within the corresponding frequency range.

A therefor handheld telephone, which herein after is referred to as a Mobile Phone, includes all portable equipment which can be used for radio communication such as mobile phones, communicators, so called organizers, or the like.

The radiation from such a Mobile Phone must primarily illuminate the horizontal half-plane comprising directions outward from the head and body of an operator. Since a Mobile Phone during a call is very close to the user, the body of the user, especially the hand and the head of the user, will influence the signalling properties of the antenna of the Mobile Phone. Consequently, the illumination of the user is desired to be as low as possible in order to direct the output power from the Mobile Phone towards the most suitable base station with a directional antenna having a cardioid shaped pattern to get the best possible communication and also the best utilization of the battery energy.

The directional antenna must be in harmony with the small size of the handheld modern Mobile Phones. A reasonable size of a 900 MHz antenna would be, for instance, height≈40 mm and diameter ≈12 mm or less. The Mobile Phone must be ready to be used without any extra measures to be taken.

How could we describe the electromagnetic field interacting with the operator? The distance between the Mobile Phone, including it s antenna, and the head of the user often is less than a wavelength. This means that the operator is in the reactive field region or in the radiating near-field region of the Mobile Phone and its antenna. This interaction between the user and the near-field region of the antenna will in general cause deteriorated antenna properties, which mainly depends on absorption and reflection losses. The losses will increase as the distance between the user and the antenna decreases.

In the reactive near-field region the reactive components of the electromagnetic fields are very large with respect to the radiating fields. The reactive fields do not radiate, but are an essential part of the radiating mechanism. The reactive field components decay in a direction from the source with the square or cube of the distance and are generally negligible relative to the radiating fields at a distance greater than a wavelength from the source.

The reactive fields in the vicinity of an antenna can be compared with the reactive field in a transformer and is described by Maxwell's second equation:

$$\nabla \times E = -\frac{\delta B}{\delta t}$$

A transformer without an external load and without any internal losses will only have a reactive field, but if a resistive load is applied on the secondary side, an active power will be transmitted to the load, which means that an active field parallel to the reactive fields will be introduced. An analogous situation is found when an operator puts the head close to a Mobile Phone, which is surrounded by reactive near-fields. This means that the head will act as a load to which active power will be transmitted and where the reactive near fields are an essential part of the radiating mechanism.

How could the illumination to the operator be reduced? At least so much that a cardioid shaped pattern resulting in some extra dB antenna gain in the direction outward from the head of the operator could be obtained.

This depends on two conditions:

a) The construction and size of the Mobile Phone.

b) The size and type of the antenna proposed.

If any part of the Mobile Phone, the chassis, the plastic cover if metallized, any of the printed circuit boards or anything else in the device having a resonance frequency inside a frequency band in which the Mobile Phone is supposed to operate, it will cause a problem to control the reactive fields. Then the theoretical mathematical expression for the radiating near-field or the field far away will be very complicated to solve, specially when it is combined with a proposal to use a miniaturized antenna, for example a miniaturized monopole antenna close to the printed circuit boards or chassis of the phone without any isolating ground plane in between. This results in induced currents, first of all in the resonant parts of the phone, as well as creating an extra interaction with the user and reduced antenna efficiency and thereby also an extra power loss.

The most simple solution of the problem can be used if the Mobile Phone structure has no resonances in any of the frequency bands in which the device is to be used, and a full length end-fed half wave antenna is proposed. What cannot be achieved in this case, without making the antenna construction still more bulky, is the directivity and gain in the zone outward from the head of the operator.

This type of problems with their different basic conditions can not be solved with one single idea or one single principle, but by means of a group of ideas and principles, where sometimes the whole group of ideas must be combined and sometimes only a single principle may be used.

The most general solution is to apply a passive reflector behind the antenna radiator. Such a construction, for instance, is disclosed in the U.S. Pat. No. 5,335,336, "Radiation shielding apparatus for a radio transmitting device", by J. Daniels, 1994. Additionally there are available several different approaches to this problem for instance U.S. Pat. No. 5,338,896 and U.S. Pat. No. 5,367,309, both from 1994. Still another solution is presented in the International Publication WO 95/31048, just to mention a few. The reflector must have a correct length and a magnitude of the spacing between the radiator and the reflector of preferably 0.1 to $0.15\times\lambda$.

As radiator a monopole and some sort of ground plane and a counterweight will be needed. If the desired radiator is a miniaturized end-fed half-wave antenna, which for instance means a helix shaped radiator with a total mechanical length somewhat shorter than a quarter of a wavelength, this will imply that it is also necessary to reduce the length of the reflector to keep the total length of the antenna system within a reasonable measure, e.g., 0.2×λ or less. It is also desired that a ground screen, or part of it, is integrated in the antenna unit. This integration may be realized by connecting a parallel line choke or a small conical, and coil to the screen of the coaxial antenna connector as is demonstrated, for example, in the Swedish Patent Application 93 02420-6.

To conclude it is evident that there is an increasing demand for further development in the area of increasing the antenna efficiency of a handhold Mobile Phone, particularly for designs which uses miniaturized antennas, to minimize the interaction with the user and at the same time presenting a device which is also always ready for use without any extra manipulation to obtain the necessary antenna function.

SUMMARY

According to the present invention an antenna unit is disclosed which constitutes a miniaturized half-wave or dipole antenna including a corresponding reflector device to minimize the interaction with a user holding the Mobile Phone to his ear. The reactive near-field of an antenna unit according to the present invention is largest in the direction outward from the user of the Mobile Phone and hence the antenna is a directional antenna.

Therefore the present invention discloses an antenna device for a Mobile Phone in which a distance between a miniaturized radiator and a miniaturized reflector may be shortened by means of an introduced dielectric material optimizing the electrical distance between the radiator and the reflector which creates a compact antenna unit having a desired cardioid shaped radiation pattern. Such an antenna unit is permanent in its operation without any further handling actions to be taken by the user.

Furthermore the present invention additionally discloses a further field reducing means in the form of metallic strips using an additional dielectric layer and at least two thin isolated metallic strips running parallel to the current edges of the reflector strip thereby forming chokes, at a back of the reflector being directed towards the user, to further concentrate the near-field to the area in between such edge twin-leads.

The antenna unit for a Mobile Phone according to the present invention has a high efficiency and consequently the signalling properties of the Mobile Phone will be good. This may also lead to a lower battery consumption as well as a higher signal-to-noise ratio (S/N-ratio) at the cellular base station.

BRIEF DESCRIPTION OF THE DRAWINGS

The invention, together with further objects and advantages thereof, may best be understood by making reference to the following description taken together with the accompanying drawings wherein like reference numerals refer to corresponding elements and in which:

FIG. 1 demonstrates in a vertical cross section an embodiment of a miniaturized antenna unit according to the present invention;

FIG. 2 demonstrates a horizontal cross section along a cut I—I of the antenna unit of FIG. 1;

DETAILED DESCRIPTION

Figure 3:
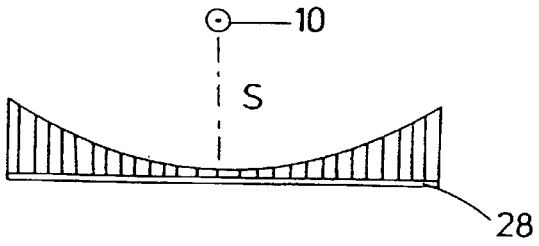
FIG. 3 demonstrates a current distribution between a monopole antenna and a metallic reflector strip.

FIG. 1 demonstrates in a simple drawing a preferred embodiment of a miniaturized antenna unit 1 for a Mobile Phone according to the present invention. The antenna unit 1, for instance for an operating frequency around 900 MHz, contains a radiator element 10 consisting of a first helical coil and a reflector element 12 consisting of a second helical coil which will be slightly larger in total length to act as a reflector element. To maintain a small height of the entire antenna unit 1 the top portion 12*a* of the reflector element 12 is circularly curved towards the top of the radiator element such that the two elements 10, 12 form an inverted U shape. This helps to keep the measure of mechanical height low without shortening the electrical length, but it also ties the charges at the top of the radiator to the charges at the top of the reflector. The total height of this inverted U shaped arrangement, for an operating frequency around 900 MHz, will then be of the order 35 mm. Between the two elements 10, 12 is placed a material 14, for instance plastic containing ceramic powder. The mechanical spacing between the radiator and the reflector has to be shortened by the introduction of a dielectric material to obtain an electrical spacing of the order 0.1 λ to 0.15 λ between the two elements 10, 12 at the operating frequency range. It is desired that this material inserted between the two elements 10, 12 exhibits an effective dielectric constant of the order 20 to 90, to practically be able to in some way match the antenna size for larger differences in wavelength used.

The first helical coil is adapted to present a ½ λ at the operating frequency band and may in one particular embodiment present a top-load 11 having a slightly larger diameter of the coiling. The first coil constituting the radiator element 10 is electrically matched and connected to the center conductor 17 of a miniature male coaxial connector 15, which will be inserted into a corresponding female coaxial connector, normally at the top of the Mobile Phone. However, it should be noted that the term "electrically connected" or just "connected" in this description refers to any galvanic, capacitive or inductive coupling, or any combination thereof.

The second helical coil constituting the reflector arrangement may be electrically connected to the circumference of the male miniature coaxial connector 15 via a metal strip 20. A first end of the strip 20 it is bent upwards at the position of the reflector element to connect to the helical coil of the reflector element 12. Consequently the reflector element 12 is thereby connected to connector screen. A further metal strip 21 below the strip 20 is also connected in the same way to the circumference of the male coaxial connector 15 and will be acting as an extra screening choke as this strip is not electrically connected to anything else but the ground portion of the coaxial connector 15. In a particular embodiment a second end portion 22 at the opposite side of the strip 20 is also bent upwards along a small portion of the radiator element 10 to add an extra capacitive choke as a screening of the bottom of the helical coil constituting the radiator element. In an additional embodiment this portion 22 need not be the strip 20 itself but just a piece of electrically conducting wire connected to the strip 20. The further metal strip 21 below the strip 20 electrically connected in the same way to the circumference of the male coaxial connector 15 will be acting as an extra screen as this strip is not electrically connected to anything else but the screen of the miniature coaxial connector 15. Thus this second L-bend or U-bend construction (Also see FIG. 1) further reduces the coupling between the antenna radiator and the Mobile Phone.

The entire arrangement is baked into a unit using a non-conducting material, e.g. rubber or the like. The small antenna unit will have a circular or semicircular shape as demonstrated in FIG. 2. In an preferred embodiment the antenna unit, for instance for a frequency in the 900 MHz range, will have a height of about 35 mm and a maximum width of about 15 mm and a minimum width of about 10 mm for a semicircular shape.

There is also another embodiment available if a very short antenna is desired (length≈0.1 λ–0.2 λ). This embodiment involves a top and bottom loaded dipole with a reflector, miniaturized by using a thin helical shaped radiator and one or two likewise helical shaped reflectors in a similar manner as demonstrated by FIG. 1. The shortening of the distance between the radiator element, or elements, and the reflector is done in the same way as previously described by means of a corresponding dielectric material according to the already described embodiment along with FIG. 1 according to the present invention.

In a further embodiment the radiator element is a helical coil corresponding to the element 10 of the preferred embodiment of FIG. 1, but the reflector element is made out of a metal strip which may be cut into a meander-like pattern to get the correct electrical length within the mechanically desired size. However, a better solution is to let the lower part of the strip instead make a 90 degree bend in under the antenna radiator for an end-feed dipole to its transformer and for a half-wave dipole and its transformer, whereby the bend of the reflector is electrically connected to the screen of the coaxial antenna connector corresponding to what was discussed regarding the elements 20 and 21 in FIG. 1. This L-bend construction of the reflector reduces the coupling between the antenna radiator and the Mobile Phone carrying the antenna.

FIG. 3 shows schematically a dipole antenna 10 in front of a metallic reflector strip 28. Most of the near-field related to the head-side of the antenna radiator is now enclosed in the space between the radiator and the reflector, but the current induced in the reflector strip will be concentrated to its parallel current edges and seen from the head-side of the antenna unit the currents are dependent of this and the result is a new near-field. However, this field may be eliminated by the twin-lead principle.

Figure 4:
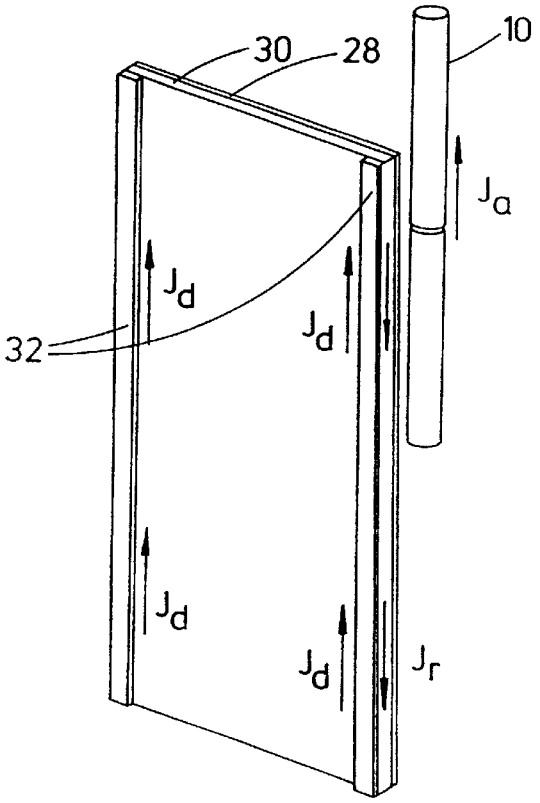
FIG. 4 demonstrates currents in the case of the antenna of FIG. 3 having an additional printed circuit board presenting end chokes at the back of the reflector.
Figure 5:
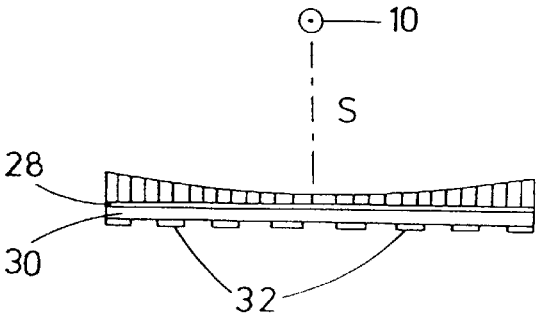
FIG. 5 demonstrates a current distribution for a case according to FIG. 4 using several such chokes at the back of the reflector element, for comparison with the current distribution of FIG. 3.

This is achieved if according to FIG. 4, a thin printed circuit board 30 comprising at least two thin isolated metallic strips 32 running parallel to the current edges of the reflector strip 28 and given the same length as the vertical part of the metallic reflector strip, is applied to the head-side of the reflector strip. The near-fields are now concentrated to the area in between the edge twin-leads. FIG. 5 demonstrates a result using several such metallic strips on the printed circuit board carrying the metallic strip 28. The thin metallic strips 32 on the board are electrically connected to the upper edge of the reflector strip, forming chokes on the back of the reflector. Something must additionally be done to the concentration of charges at the top and bottom of the half-wave dipole. At the top it is recommended to apply some sort of top-load, and the same type of load can be applied also at the bottom for an end-fed dipole.

This is applicable to FIG. 1 where such a coil 11 will collect the field flux from the upper part of the radiator, and beneath this coil the two parallel U shaped, dielectrically loaded metallic strips are connected, which form a miniaturized integrated ground plane, for example, including two chokes.

Consequently in the solution in accordance with the principle of the present invention most of the near-fields in a direction towards a user will be concentrated in the dielectric area between the reflector and the radiator by the further action of the chokes thereby additionally improving the efficiency of the antenna in a desired direction towards a cellular base. At the same time an antenna unit is obtained, which is permanently operative without any further handling actions by a user.

What is claimed:

1. An antenna device for a Mobile Phone, comprising:

a miniaturized radiator member for producing a radiated electromagnetic field;

a miniaturized reflector member having a length slightly greater than the radiator member and connected to a ground portion of a coaxial connector feeding the miniaturized radiator member for directing a radiated electromagnetic field away from a user; and a dielectric material disposed between the miniaturized radiator member and the miniaturized reflector member, whereby the electrical distance between said miniaturized radiator member and said miniaturized reflector member is shortened, to create a compact directional antenna unit having a cardioid shaped pattern.

2. The antenna device according to claim 1, wherein said first dielectric material is a material presenting an effective dielectric constant in a range of 20 to 90, to obtain an electrical distance of the order 0.1 λ to 0.15 λ between said miniaturized radiator member and said miniaturized reflector member.

3. The antenna device according to claim 2, wherein said dielectric material comprises plastics material containing ceramic powder.

4. The antenna device according to claim 1, wherein said miniaturized radiator member and said miniaturized reflector member comprise helical coils.

5. An antenna device for a Mobile Phone, comprising:

a miniaturized radiator member for producing a radiated electromagnetic field;

a miniaturized reflector member for directing the radiated electromagnetic field away from a user;

a dielectric material disposed between the miniaturized radiator member and the miniaturized reflector member, whereby the electrical distance between said miniaturized radiator member and said miniaturized reflector member is shortened creating a compact directional antenna unit having a cardioid shaped pattern, wherein at least one of the miniaturized radiator member and the miniaturized reflector member comprises a helical coil, and wherein a top portion of said miniaturized reflector member is bent over a top portion of said miniaturized radiator member thereby presenting an inverted U shape to further shorten the height of said compact antenna.

6. The antenna device according to claim 5, wherein said compact antenna unit is baked into a circular or semicircular antenna device using a nonconducting material.

7. The antenna device according to claim 6, wherein said compact antenna unit is always operational without any further handling actions by a user.

8. The antenna device according to claim 1, wherein said miniaturized radiator member is a helical coil and said miniaturized reflector element is made out of a metallic strip cut into a meander-like pattern to obtain a correct electrical length.

9. The antenna device according to claim 8, wherein at least two thin isolated metallic strips are running parallel to the edges of said metallic strip forming said miniaturized reflector member, said metallic strips being applied to an insulated back side of said miniaturized reflector element normally facing the user and said metallic strips at one end being electrically connected to the reflector element, thereby forming chokes on the back of said miniaturized reflector element having said meander-like pattern.

10. The antenna device according to claim 9, wherein said chokes are formed on the back of a printed circuit board, which on its opposite side carries said metallic strip cut into the meander-like pattern.

11. The antenna device according to claim 10, wherein said chokes are electrically connected to the upper portion of said metallic strip forming the reflector member.

12. The antenna device according to claim 11, wherein said compact antenna unit is baked into a circular or semi-circular antenna device using a nonconducting material.

13. The antenna device according to claim 12, wherein said compact antenna unit is always operational without any further handling actions by a user.

14. The antenna device according to claim 2, wherein said miniaturized radiator member is a helical coil and said miniaturized reflector element is made out of a metallic strip cut into a meander-like pattern to obtain a correct electrical length.

15. The antenna device according to claim 14, wherein at least two thin isolated metallic strips are running parallel to the edges of said metallic strip forming said miniaturized reflector member, said metallic strips being applied to an insulated back side of said miniaturized reflector element normally facing the user and said metallic strips at one end being electrically connected to the reflector element, thereby forming chokes on the back of said miniaturized reflector element.

16. The antenna device according to claim 15, wherein said chokes are formed on the back of a printed circuit board, which on its opposite side carries said metallic strip.

17. The antenna device according to claim 16, wherein said chokes are electrically connected to the upper portion of said metallic strip forming the reflector member.

18. The antenna device according to claim 17, wherein said compact antenna unit is baked into a circular or semi-circular antenna device using a nonconducting material.

19. The antenna device according to claim 18, wherein said compact antenna unit is always operational without any further handling actions by a user.

20. The antenna device according to claim 3, wherein said miniaturized radiator member is a helical coil and said miniaturized reflector element is made out of a metallic strip cut into a meander-like pattern to obtain a correct electrical length.

21. The antenna device according to claim 20, wherein at least two thin isolated metallic strips are running parallel to the edges of said metallic strip forming said miniaturized reflector member, said metallic strips being applied to an insulated back side of said miniaturized reflector element normally facing the user and said metallic strips at one end being electrically connected to the reflector element, thereby forming chokes on the back of said miniaturized reflector element.

22. The antenna device according to claim 21, wherein said chokes are formed on the back of a printed circuit board, which on its opposite side carries said metallic strip.

23. The antenna device according to claim 22, wherein said chokes are electrically connected to the upper portion of said metallic strip forming the reflector member.

24. The antenna device according to claim 23, wherein said compact antenna unit is baked into a circular or semi-circular antenna device using a nonconducting material.

25. The antenna device according to claim 24, wherein said compact antenna unit is always operational without any further handling actions by a user.

26. An antenna assembly for use in a mobile phone, comprising:

a radiator element for radiating an electromagnetic field, the radiator element comprising a substantially helical-shaped conductor having a first radius of curvature and comprising a top load portion having a second radius of curvature, slightly larger than the first radius of curvature;

a reflector element for reflecting radiation radiated from the radiator element, the reflector element comprising a substantially helical-shaped conductor having a first section extending along an axis adjacent to the radiator element and a second section extending along a curve to position an end of the reflector element adjacent the top load; and a dielectric material having a dielectric constant that measures between 20 and 90 disposed between the radiator element and the reflector element.

27. An antenna assembly according to claim 26, wherein:

the reflector element further includes a third section extending adjacent the radiator element opposite the first section that provides a capacitive choke to the radiator element.

28. An antenna element according to claim 27, further comprising:

an electrically conductive strip disposed adjacent portions of the third section of the radiator element.

* * * * *